US010598390B2

(12) United States Patent
Carcano et al.

(10) Patent No.: US 10,598,390 B2
(45) **Date of Patent: *Mar. 24, 2020**

(54) SYSTEM FOR CLEANING CIRCULATING OVEN AIR WITH REDUCED THERMAL DISRUPTION

(71) Applicant: ILLINOIS TOOL WORKS INC., Glenview, IL (US)

(72) Inventors: Marco Carcano, Senago (IT); Michele Gentile, Jesi (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 196 days.

This patent is subject to a terminal disclaimer.

(21) Appl. No.: 15/816,071

(22) Filed: Nov. 17, 2017

(65) Prior Publication Data

US 2018/0149370 A1 May 31, 2018

Related U.S. Application Data

(60) Provisional application No. 62/428,141, filed on Nov. 30, 2016, provisional application No. 62/550,130, filed on Aug. 25, 2017.

(51) Int. Cl.
*H05B 6/64* (2006.01)
*F24C 15/20* (2006.01)
(Continued)

(52) U.S. Cl.
CPC ..... *F24C 15/32* (2013.01); *F24C 15/2014* (2013.01); *F24C 15/322* (2013.01); *F24F 3/16* (2013.01); *H05B 6/6473* (2013.01)

(58) Field of Classification Search
CPC ..... F24C 15/20; F24C 15/32; H05B 6/64
(Continued)

(56) References Cited

U.S. PATENT DOCUMENTS 2,862,095 A 11/1958 Scofield
3,416,509 A * 12/1968 Huebler ..... F24C 14/025 126/21 A
(Continued)

FOREIGN PATENT DOCUMENTS

GB 1216678 A 12/1970
JP S5168264 U 5/1976
(Continued)

OTHER PUBLICATIONS

International Search Report and Written Opinion of PCT/US2017/061739 dated Feb. 26, 2018, all enclosed pages cited.
(Continued)

*Primary Examiner* — Edelmira Bosques
*Assistant Examiner* — Nikhil P Mashruwala
(74) *Attorney, Agent, or Firm* — Burr & Forman LLP

(57) ABSTRACT

An air cleaning system for an oven that includes a cooking chamber configured to receive a food product includes a catalytic assembly and a preheater. The catalytic assembly may be configured to clean air expelled from the cooking chamber. The preheater may be configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

20 Claims, 8 Drawing Sheets

(51) Int. Cl.
*F24C 15/32* (2006.01)
*F24F 3/16* (2006.01)

(58) Field of Classification Search
USPC ..... 126/21 R, 21 A
See application file for complete search history.

(56) References Cited

U.S. PATENT DOCUMENTS 3,587,557 A * 6/1971 Henderson et al. .. F24C 14/025 126/21 A
3,656,915 A * 4/1972 Tourtellotte ..... B01J 8/048 422/171
3,783,854 A * 1/1974 Hurko ..... F24C 14/025 126/21 R
5,089,679 A * 2/1992 Eke ..... H05B 6/645 126/21 A
6,376,817 B1 4/2002 McFadden
6,904,903 B1 6/2005 Vroom
6,913,012 B2 * 7/2005 Divett ..... F24C 15/006 126/21 A
8,138,452 B2 3/2012 Thomas
8,217,314 B2 7/2012 Kim
8,294,070 B2 * 10/2012 McNamee ..... A21B 1/245 219/679
8,800,542 B1 8/2014 Kennington
8,813,740 B2 * 8/2014 Linton ..... A47J 37/0694 126/332
2003/0116555 A1 6/2003 Wakefield et al.
2007/0107712 A1 * 5/2007 Shiraichi ..... F24C 15/325 126/21 A
2007/0295718 A1 * 12/2007 Takei ..... H05B 6/80 219/756
2009/0064986 A1 * 3/2009 Leidig ..... F24C 15/325 126/21 A
2009/0159066 A1 * 6/2009 Adame ..... F24B 7/005 126/58
2012/0233876 A1 * 9/2012 Weldon ..... D06F 58/20 34/513
2013/0152913 A1 6/2013 Raghavan et al.
2017/0082301 A1 * 3/2017 Tommasin ..... F24C 15/327
2017/0089591 A1 * 3/2017 Rogers ..... F24C 15/322
2018/0152998 A1 * 5/2018 Rollet ..... H05B 6/6435

FOREIGN PATENT DOCUMENTS

JP S5170160 U 6/1976
WO 2009049081 A1 4/2009

OTHER PUBLICATIONS

International Search Report and Written Opinion of PCT/US2017/063258 dated Mar. 8, 2018, all enclosed pages cited.
Office Action issued in U.S. Appl. No. 15/810,974 dated Jul. 29, 2019, all enclosed pages cited.

* cited by examiner

SYSTEM FOR CLEANING CIRCULATING OVEN AIR WITH REDUCED THERMAL DISRUPTION

CROSS REFERENCE TO RELATED APPLICATIONS

This application claims priority to U.S. application Nos. 62/428,141 filed Nov. 30, 2016 and 62/550,130 filed Aug. 25, 2017, the entire contents of which are incorporated by reference in their entirety.

TECHNICAL FIELD

Example embodiments generally relate to ovens and, more particularly, relate to an oven that is enabled to facilitate cleaning of the air circulated through the cooking chamber of the oven with reduced impact on thermal conditions in the oven.

BACKGROUND

Cooking inherently generates fumes and particulates that can dirty the interior of the oven and/or foul the exhaust gasses leaving the oven. To address these issues, some ovens have employed catalytic converters, or other such cleansing technologies.

A catalytic converter generally uses a catalyst to facilitate a chemical reaction to convert toxic gases or pollutants in the exhaust gas into less harmful states by catalyzing a redox reaction. In particular, the catalytic converter is typically placed in communication with the gases in or leaving the oven to treat the gases. In some cases, a separate flow path may be created for cycling at least some of the air that generally flows through the convection system of the oven through the catalytic converter. If the flow path draws air directly from or inserts air directly into the cooking chamber, direct impacts on the temperature in the oven can be noticed, and the uniformity of the oven's cooking ability may be disrupted. Meanwhile, if other strategies for drawing and cleaning air are employed, other disruptive impacts on system efficiency or cooking uniformity may be noticed.

The catalytic converter itself uses high temperatures to burn toxic gases or pollutants. Conventional catalytic converters have attempted to improve catalytic converter efficiency, in some cases, by preheating the gas provided on the inlet line to the catalytic converter itself. Others have cooled catalytic converter output gases in the outlet line from the catalytic converter. However, the impacts of the airflow for the catalytic converter within the oven cavity itself has generally not been a significant focus area for technological improvement. Accordingly, some example embodiments may be provided to address this area.

BRIEF SUMMARY OF SOME EXAMPLES

Some example embodiments may therefore provide improved system for cleaning air in an oven. The air flow circuit in which the catalytic converter is provided may use the air that has been heated by the catalytic assembly to heat the air that is being introduced into the cooking chamber. In this regard, a heat exchanger may be provided to heat fresh air being provided into the cooking chamber with the heated air from the catalytic assembly thereby also cooling the air from the catalytic assembly before it is discharged. Accordingly, the cooking processes in the oven may not be disrupted by introduction of air that is excessively cool, and the air that is expelled from the oven may also be cooler to avoid the creation of hot work spaces or increased cooling requirements for the cooling of people and equipment in work spaces.

In an example embodiment, an oven is provided. The oven may include a cooking chamber configured to receive a food product, and an air circulation system configured to provide heated air into the cooking chamber. The air circulation system may include an air cleaning system. The air cleaning system may include a catalytic assembly and a preheater. The catalytic assembly may be configured to clean air expelled from the cooking chamber. The preheater may be configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

In an example embodiment, an air cleaning system for an oven may be provided. The oven may include a cooking chamber configured to receive a food product. The air cleaning system may include a catalytic assembly and a preheater. The catalytic assembly may be configured to clean air expelled from the cooking chamber. The preheater may be configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
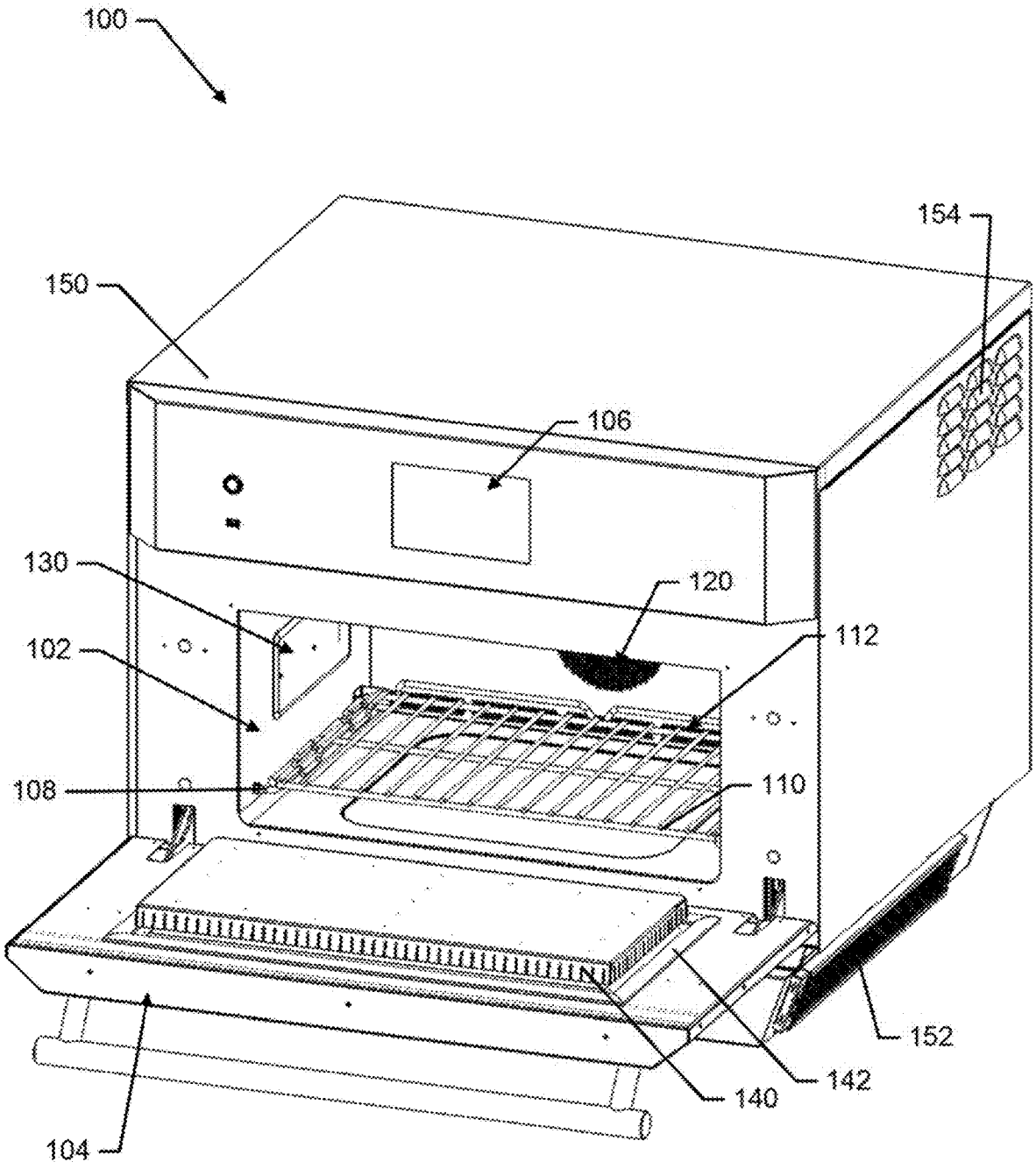
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food with greater uniformity due to the minimization of temperature variations introduced by air provided into the oven cavity, and air expelled from the oven for an air circuit or system in which the catalytic converter is provided.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 from parallel to the ground. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through a heat exchanger system so that fresh air is heated before introduction into the cooking chamber 102, and cleaned air is cooled before being expelled. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. As such, air drawn into the inlet array 152 can reliably be expected to be air at ambient room temperature, and not recycled, expelled cooling air.

Figure 2:
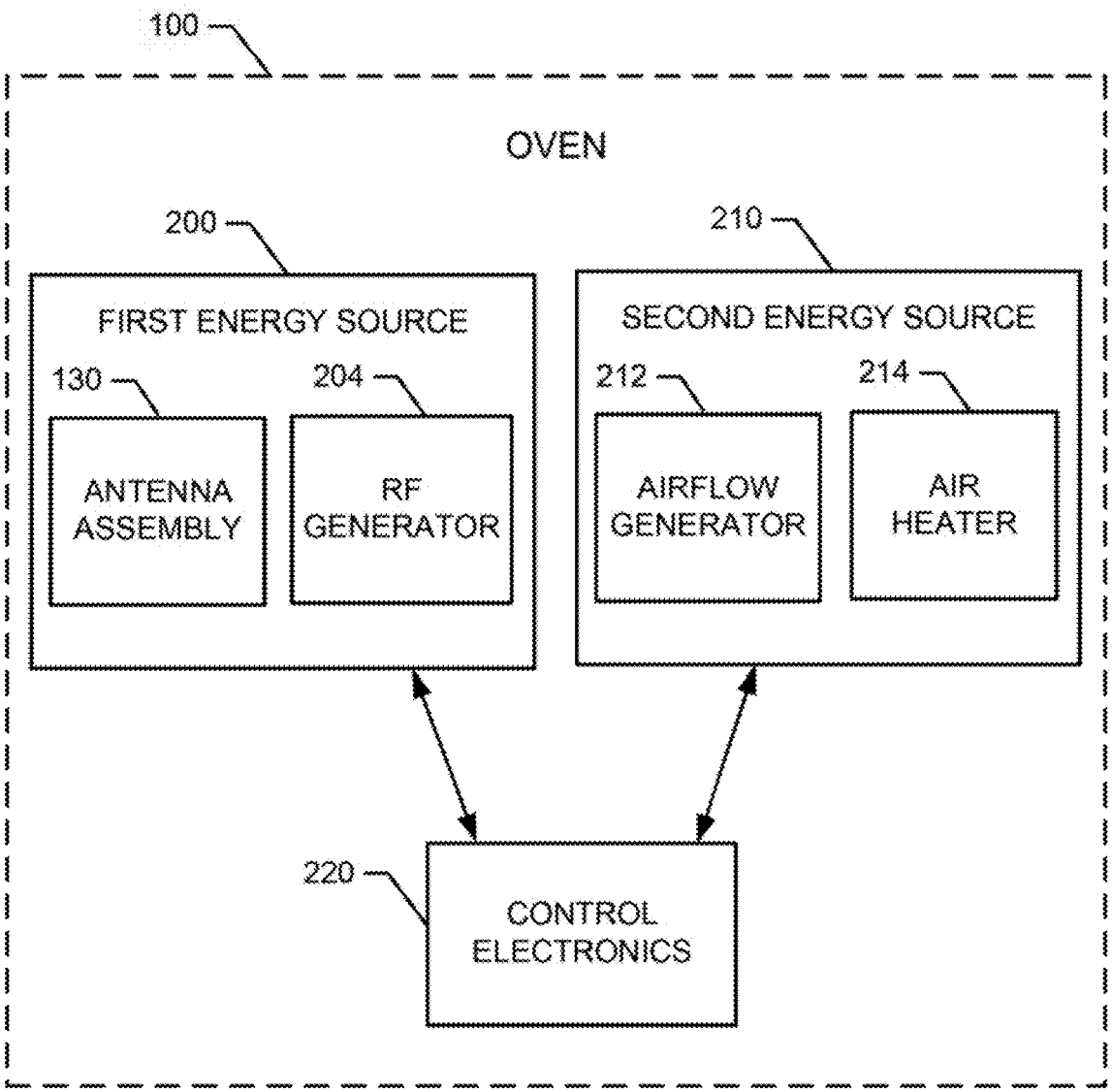
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

Figure 3:
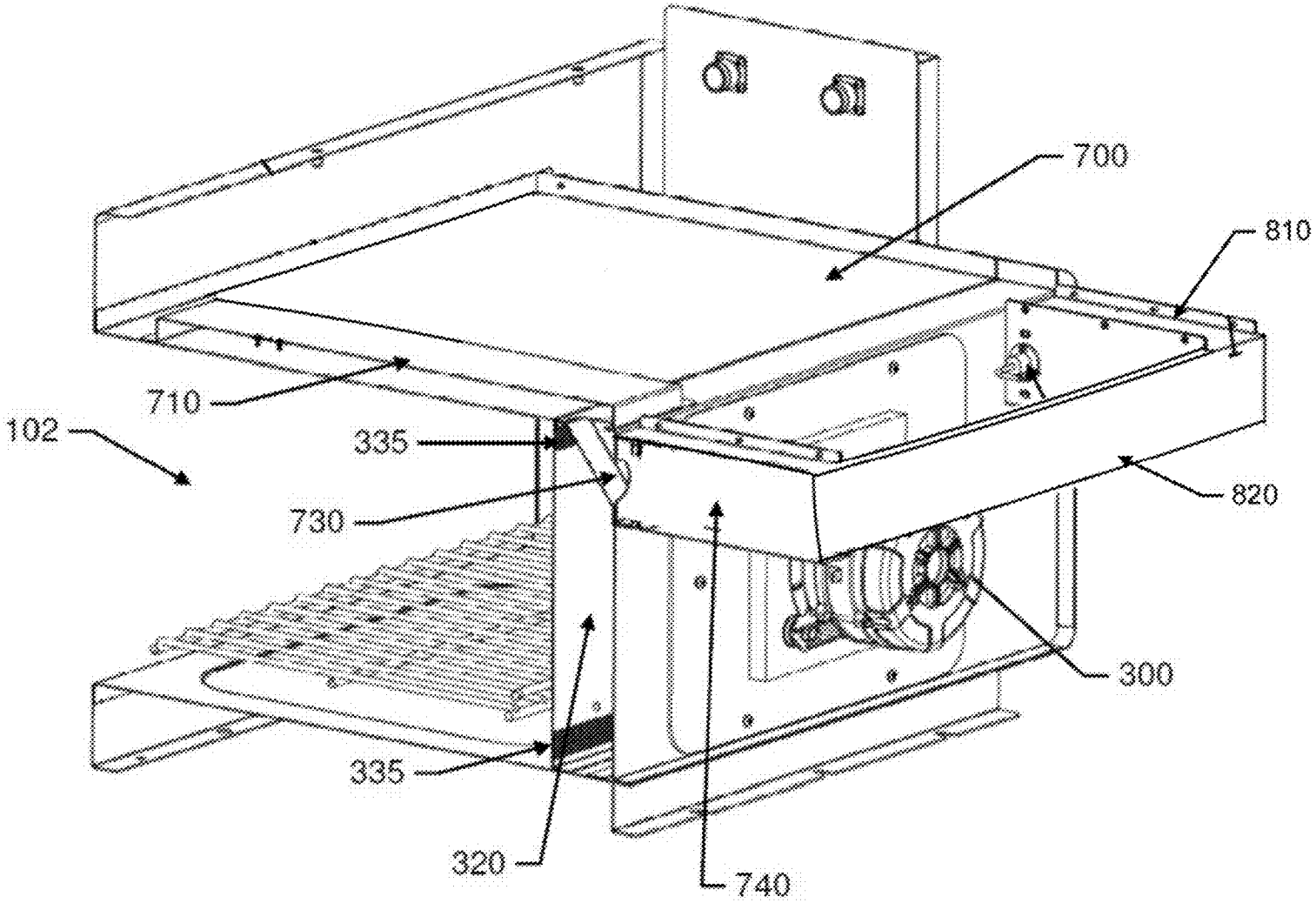
FIG. 3 shows a perspective view of a cooking chamber of the oven with various covers removed to expose the air cleaning system according to an example embodiment.

As discussed above, the first air circulation system may be configured to drive heated air through the cooking chamber 102 to maintain a steady cooking temperature within the cooking chamber 102. The typical airflow path can be seen from FIGS. 3-5. In this regard, FIG. 3 shows a perspective view of the cooking chamber 102 to show the air cleaning system of an example embodiment. The airflow path can also be seen in reference to FIG. 4A, which shows a front view looking inside the cooking chamber 102 to a back wall of the cooking chamber 102, and FIG. 4B, which isolates the back wall of the cooking chamber 102. FIG. 5 illustrates a cross section view taken from the right side of the oven 100.

Referring primarily to FIGS. 3, 4A, 4B, and 5, a fan assembly 300 includes an impeller 310 that draws air from the cooking chamber 102 and into a plenum 320. Inside the plenum 320, heating coils 322 heat the air to a desired temperature. The heated air is then distributed back into the cooking chamber 102. In this arrangement, it should be appreciated that the fan assembly 300 is one example implementation of the airflow generator 212 of FIG. 2. Similarly, the heating coils 322 are one example implementation of the air heater 214 of FIG. 2.

The fan assembly 300 may draw air into the plenum 320 through outlet perforations 330 in a back wall of the cooking chamber 102. The outlet perforations 330 may be substantially aligned with the impeller 310 of the fan assembly 300 to provide an outlet of air from the cooking chamber 102 and into the plenum 320. The fan assembly 300 may include a centrifugal pump. As such, the operation of the impeller 310 may create a low pressure region at the outlet perforations 330 to draw air therein, and the plenum 320 may therefore be a higher pressure region relative to the pressure of the cooking chamber 102. The impeller 310 may thrust the air outward from an axis of the impeller 310 and the higher pressure in the plenum 320 may then cause the air to pass proximate to the heating coils 322 to increase the temperature of the air prior to the heated air being pushed back into the cooking chamber 102 via the inlet perforations 335. The inlet perforations 335 provide an inlet path for heated air into the cooking chamber 102 from the plenum 320 based on the higher pressure created in the plenum 320 by operation of the fan assembly 300. The inlet perforations 335 and outlet perforations 330 may be formed from individual perforations that are sized to block any escape of RF energy (at the frequencies employed during operation of the oven 100) from the cooking chamber 102.

Figure 4A:
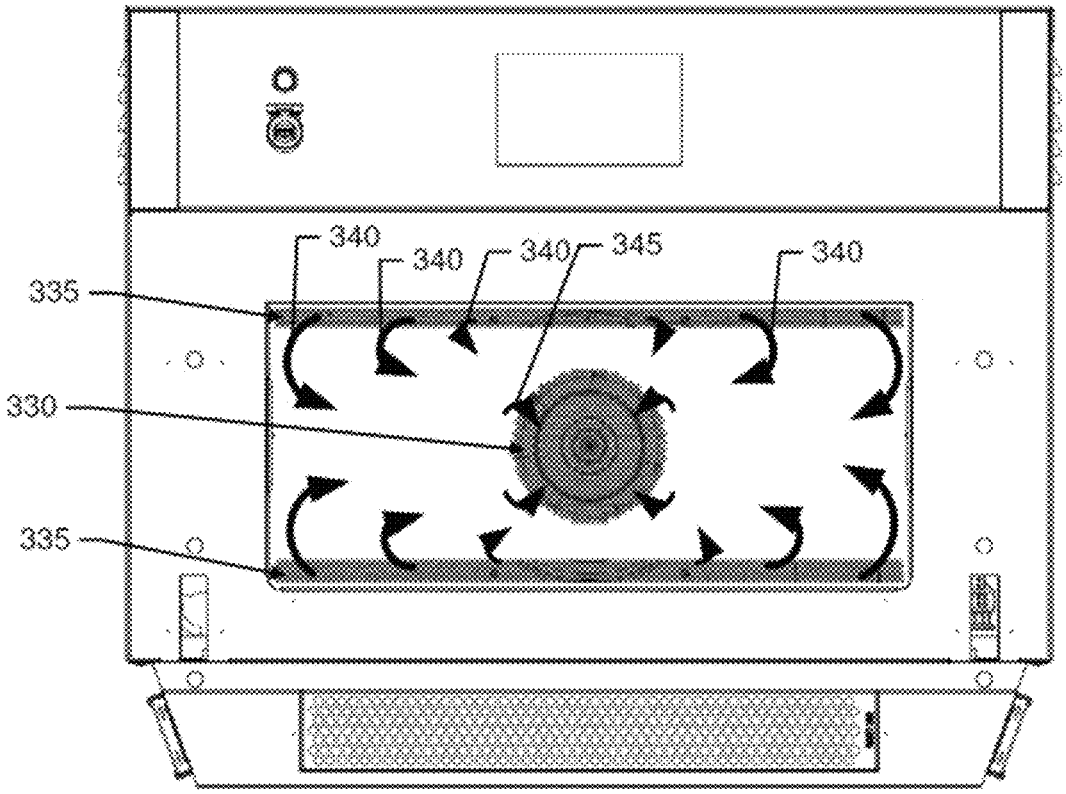
FIG. 4A illustrates a front view looking inside the cooking chamber to a back wall of the cooking chamber according to an example embodiment.
Figure 4B:
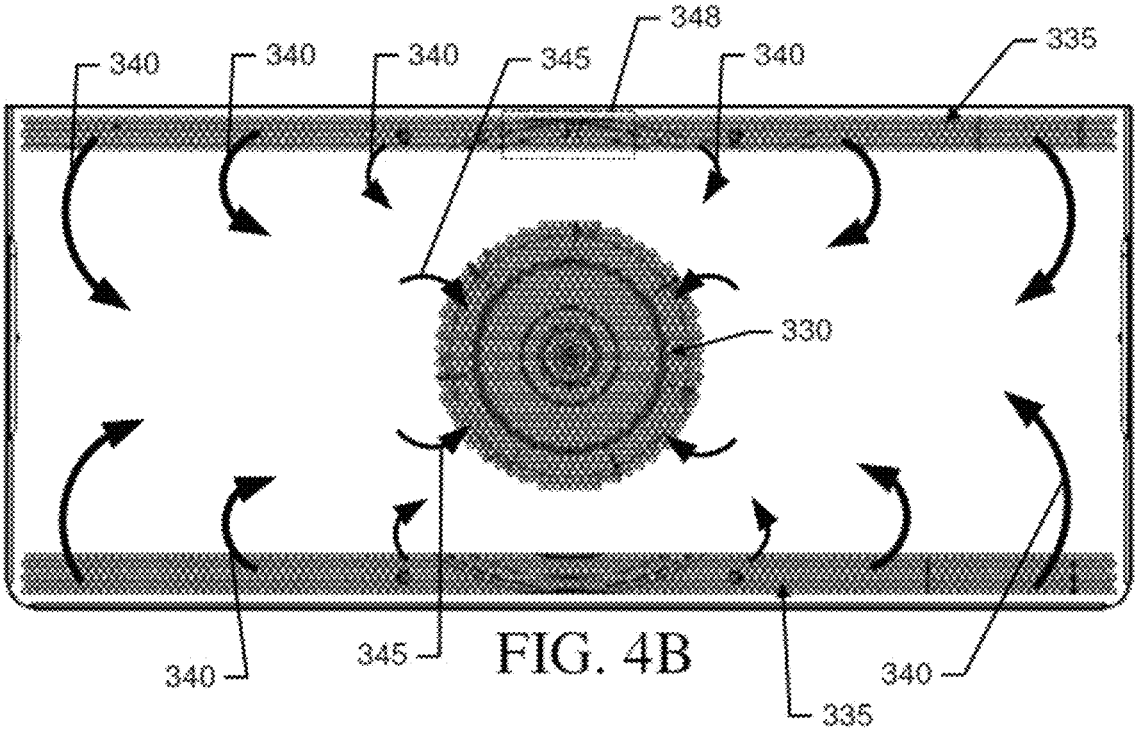
FIG. 4B is an isolation view of only the back wall of the cooking chamber to illustrate perforations therein and flow paths through the back wall according to an example embodiment.
Figure 5:
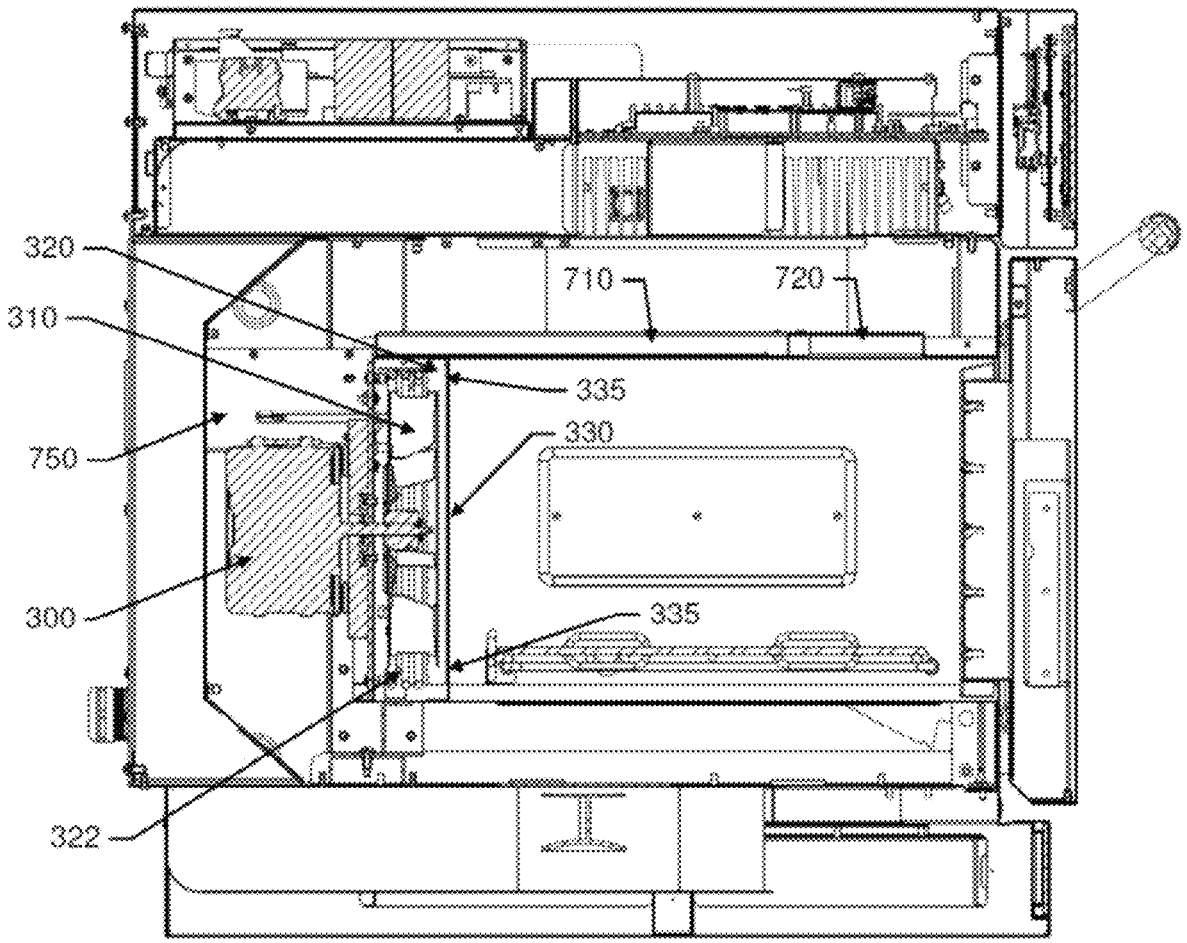
FIG. 5 illustrates a cross section view taken from the right side of the oven from front to back according to an example embodiment.

FIGS. 4A and 4B illustrate the flow paths described above. In this regard, heated air 340 (represented by arrows having the reference number 340 in FIGS. 4A and 4B) is provided from the plenum 320 and into the cooking chamber 102 via the inlet perforations 335. Meanwhile, exhaust air 345 (represented by arrows having the reference number 345 in FIGS. 4A and 4B) is drawn from the cooking chamber 102 and into the plenum 320 via the outlet perforations 330.

The inlet perforations 335 may be split into two separate strips of perforations that extend linearly across the top and bottom of the back wall of the cooking chamber 102. The strips of perforations may be further formed from individual rows of perforations that extends linearly along a direction substantially parallel to the plane in which the bottom (or top) of the cooking chamber 102 lies. In some cases, the number of rows of perforations that form the strip of perforations near the bottom of the cooking chamber 102 may be larger than the number of rows of perforations that form the strip of perforations near the top of the cooking chamber 102 to provide more flow circulation from the bottom and directed upward than the amount of flow circulation directed from the top and downward. In an example embodiment, the number of rows of perforations that form the strip of perforations near the bottom of the cooking chamber 102 may be six and the number of rows of perforations that form the strip of perforations near the top of the cooking chamber 102 may be five. However, other arrangements are also possible.

As shown primarily in FIGS. 4A and 4B, the outlet perforations 330 may be formed into a circular shape to substantially match the size of the inlet of the fan assembly 300 to the impeller 310. Meanwhile, the inlet perforations 335 are linearly shaped to match the shape of the top and bottom of the cooking chamber 102. Due to the force of the impeller 310 driving the air inside the plenum 320 outwardly, in some cases, the magnitude of airflow of heated air 340 may be larger as you get farther away from the outlet perforations 330. Or at least in some cases, the magnitude of airflow of heated air 340 may be relatively small at portions of the inlet perforations 335 that are closest to the outlet perforations 330. For this reason, in some cases, instead of being continuous strips of perforations, the inlet perforations 335 may be split into two or more parts by one or more divider portions. In this regard, region 348 is outlined with dashed lines in FIG. 4B and illustrates a portion of the top row of inlet perforations 335 that could be filled in with solid material (i.e., lacking any perforations) to form a divider portion. A similar region on the bottom row of inlet perforations 335 may also be provided in some cases.

The air circulated through first air circulation system may be controlled based on user inputs defined at the interface panel 106 either directly or indirectly (e.g., by selection of a cooking program or recipe). Thus, for example, both the air temperature and the fan speed may be selected, and operation of the fan assembly 300 and the heating coils 322 may be controlled accordingly by the control electronics 220. However, during cooking processes, various gases and/or particulates may become introduced into the air that circulates through the first air circulation system. Particularly when the gasket 142 is restrictive of allowing airflow therethrough, it may be desirable to provide an air cleaning system as part of the first air circulation system.

Figure 6:
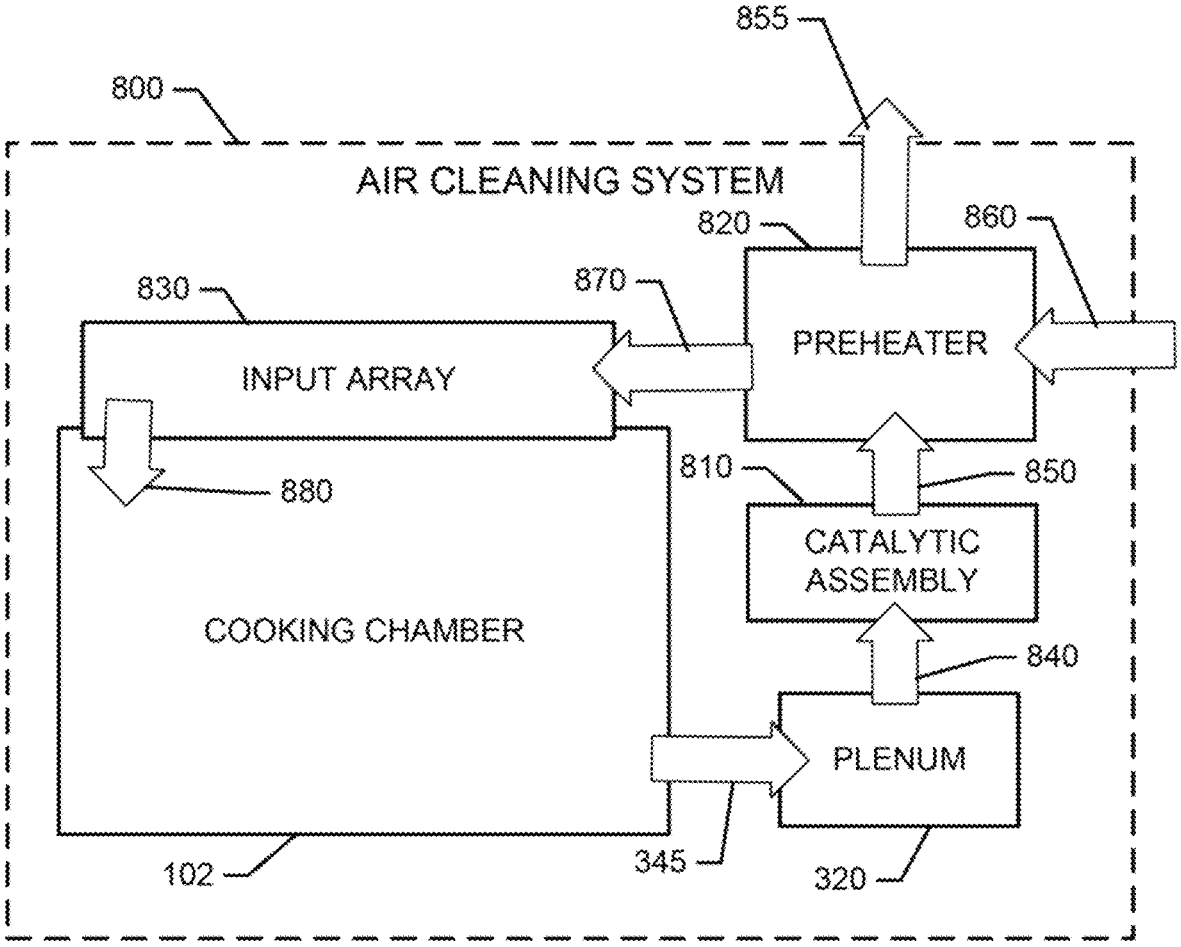
FIG. 6 illustrates a block diagram of an air cleaning system in accordance with an example embodiment.
Figure 7A:
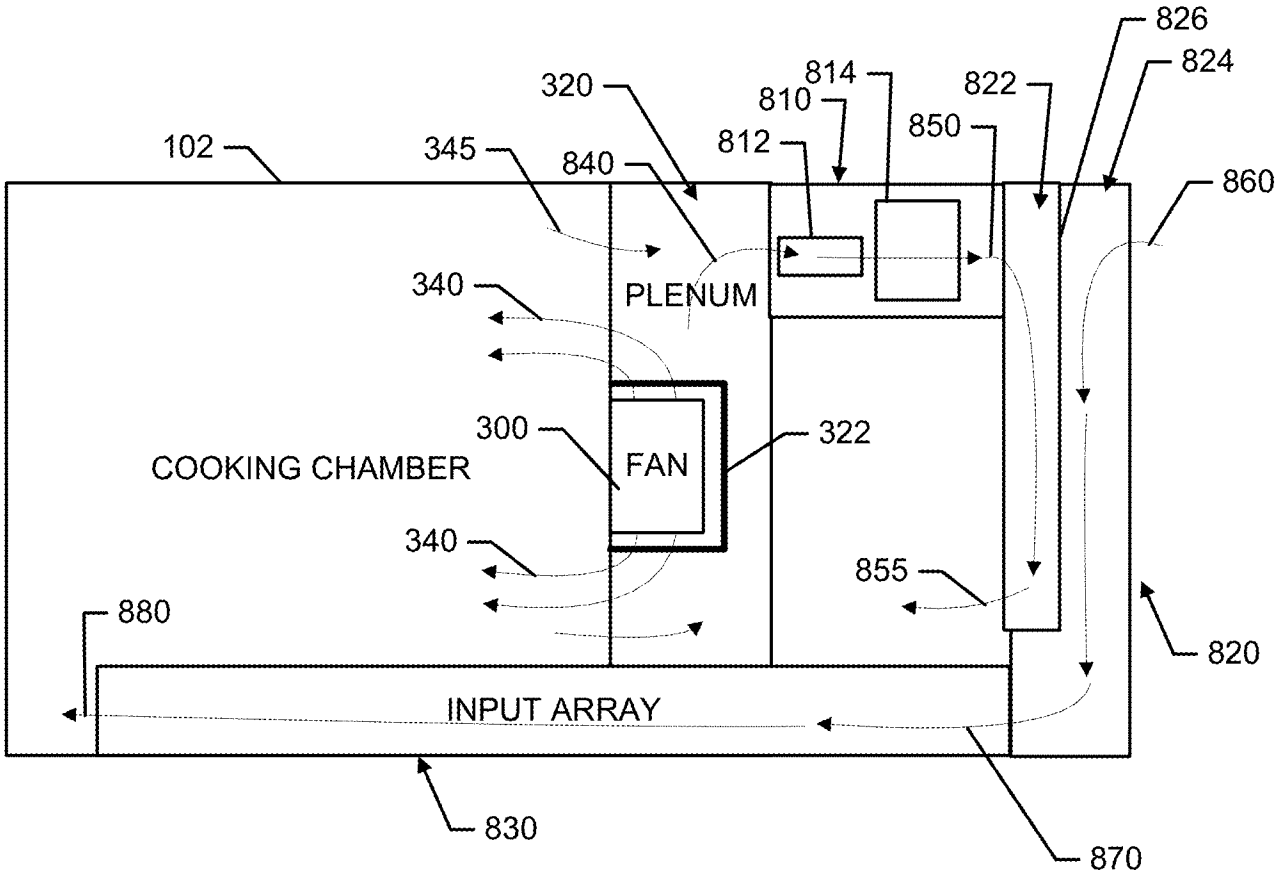
FIG. 7, which is defined by FIGS. 7A and 7B, shows a top, plan view of the air cleaning system and concentrically arranged tubes, respectively, in accordance with an example embodiment.
Figure 7B:
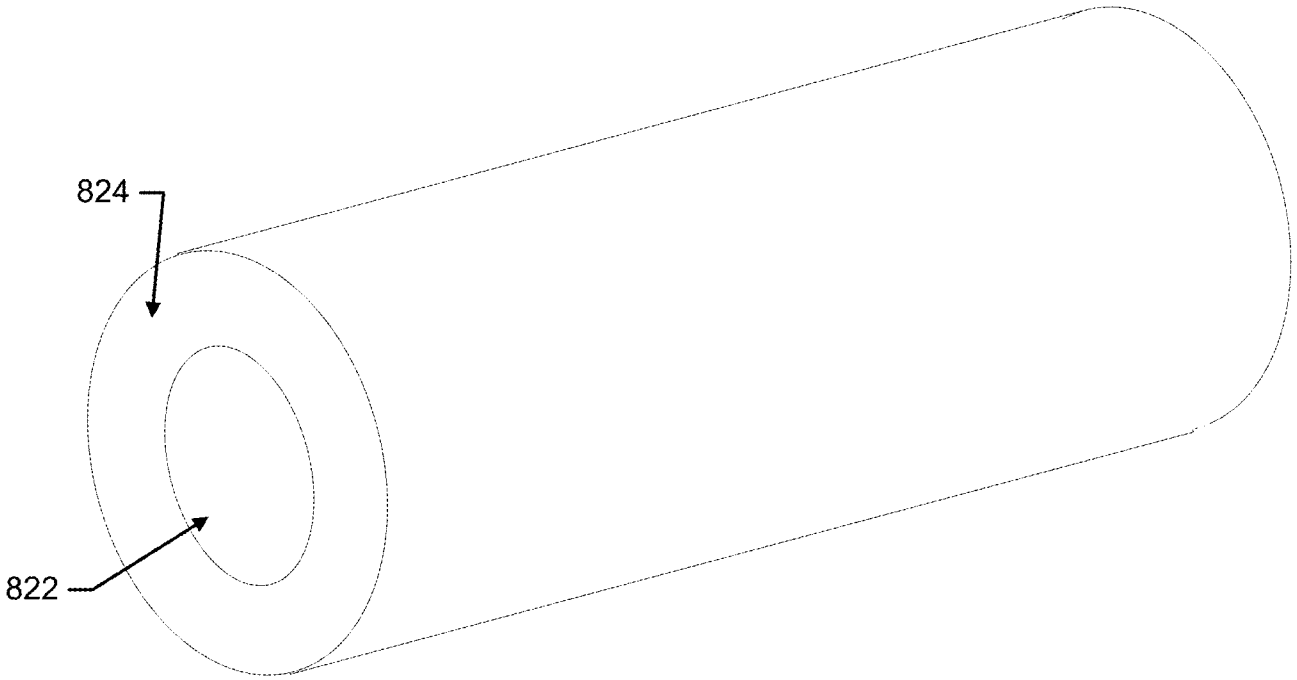

FIG. 6 illustrates a block diagram of an air cleaning system 800 in accordance with an example embodiment, and FIG. 7 illustrates a top, plan view of various components of the air cleaning system 800 in accordance with an example embodiment. Referring primarily to FIGS. 6 and 7, the air cleaning system 800 may include a catalytic assembly 810, a preheater 820 and an input array 830. These components, which define at least a portion of the air cleaning system 800, may be operably coupled to various components of the oven 100, and particularly to various components of the first air circulation system to use the motive force of the first air circulation system to drive flow in the air cleaning system 800. As such, for example, the air cleaning system 800 may use pressure differentials created by the first air circulation system to drive flow through the components of the air cleaning system 800.

In this regard, the cooking chamber 102 may be at a relatively low pressure due to the operation of the fan assembly 300, which in turn also makes the plenum 320 have a relatively high pressure. Air is pushed from the relatively high pressure area of the plenum 320 through the catalytic assembly 810, where the air is cleaned. The catalytic assembly 810 may include a heating element 812 and a catalytic element 814 at which a catalyst is provided for catalyzing toxic pollutants and/or other materials via a redox reaction. In some cases, the catalytic assembly 810 may further include a flow regulator and/or temperature sensors to attempt to regulate the heat transfer process that is conducted in the preheater 820. As such, the flow regulator and/or temperature sensors could alternatively be provided in the preheater 820 or at other portions of the air cleaning assembly 800. The heating element 812 and the catalytic element 814 may be disposed in an insulated compartment that extends rearwardly from the plenum 320 and is operably coupled to the preheater 820.

Air that has been cleaned may pass through the flow regulator, which is generally at a pressure level that is in between the high pressure of the plenum 320 and the low pressure of the cooking chamber 102. The flow regulator (if employed) may, however, be modified to vary the flow rate through the air cleaning system 800 in some embodiments. In this regard, for example, the flow regulator may include a valve, flap or other movable member that can be operated to increase or decrease the flow through the air cleaning system 800. In some embodiments, the flow regulator may include a flap that is operable via application of magnetic force or via a solenoid. Thus, when the magnetic force is applied, the flap may be moved to either an open or a closed position, and when the magnetic force is not applied, the flap may move to the opposite position. The position of the flap may be controlled based on the temperature in the catalytic assembly 810 (or catalyzer) as determined by a temperature sensor. After passing through the flow regulator, the air that has been cleaned may pass through the preheater 820 and input array 830 before being inserted back into the cooking chamber 102 to complete the flow path for the air cleaning system 800.

As shown in FIGS. 6 and 7, exhaust air 345 from the cooking chamber 102 may enter into the plenum 320, the exhaust air 345 and perhaps also some air expelled directly from the fan assembly 300 may then be pushed from the plenum 320 into the catalytic assembly 810 as un-cleaned air 840. The un-cleaned air 840 may pass through the catalytic assembly 850 and be cleaned by operation of the heating element 812 and the catalytic element 814. The heating element 812 may be a resistive heating element or coil that operates to increase the temperature of the un-cleaned air 840 by, for example, 100° C. (180° F.). The catalytic element 814 may operate on air that is, for example, hotter than 220° C. (428° F.), which may correlate to a minimum working temperature of the oven 100. Thus, the catalytic element 814 may be maintained within the active working and safe temperature area of about 200° C. to about 600° C.

After operation of the catalytic assembly 810, cleaned air 850 is generated and the differential pressures in the system continue to operate so that the cleaned air 850 moves into the preheater 820. The preheater 820 may include adjacent ducts or tubes (in some cases concentrically arranged as shown by outlet duct 822, which is located inside inlet duct 824 in the alternative design shown in FIG. 7B) to maximize surface area over which heat transfer can occur between the fluids (i.e., different air currents) passing over the surface area of the preheater 820 can exchange heat. The preheater 820 may include an outlet duct 822 that passes the cleaned air 850 proximate to the heat transfer surface before expelled air 855 is released from the oven 100 (e.g., via outlet louvers 154). Meanwhile, an inlet duct 824 may take fresh air 860 from outside the oven 100 and pass the fresh air 860 proximate to the heat transfer surface to heat the fresh air 860 before heated input air 870 is pushed into the input array 830. The input array 830 may carry and deliver input air 880 into the cooking chamber 102. The input air 880 may have a higher temperature than the fresh air 860 and therefore be less disruptive to the internal temperature inside the cooking chamber 102.

Accordingly, in order to avoid introduction of air that is at a significantly different temperature than the cooking chamber 102, which could alter internal temperatures of the cooking chamber 102, and impact the uniformity of cooking, the preheater 820 may be provided to preheat some of the air in the air cleaning system 800, while cooling other air. The preheater 820 of an example embodiment may act as a heat exchanger to allow the heat of the cleaned air 850 to condition the fresh air 860 so that thermal shock or even smaller impacts on internal cooking chamber 102 temperature does not occur upon introduction of the input air 880 into the cooking chamber 102 via the input array 830. Although it is generally expected that the preheater 820 will increase the temperature of air being provided to the input array 830 to match or nearly match the internal temperature of the cooking chamber 102, it should be appreciated that the preheater 820 also cools down the air being expelled from the oven 100. In order to accomplish the desired result of allowing the air from the catalytic assembly 810 to interact with (i.e., transfer heat to/from) the air being provided to the input array 830 to equalize (or at least tend to equalize) the temperatures in the two corresponding volumes, the preheater 820 may be structured so that the output duct 822 and the inlet duct 824 share a common wall 826 (e.g., the heat transfer surface discussed above) that can act as a heat exchanger or medium for heat transfer.

Example structures for the components of FIG. 6 can be seen in FIGS. 3-5, and 7. As shown in FIGS. 3-5 and 7, the preheater 820 may be formed between opposing sidewalls of the oven 100 such that, for example, the catalytic assembly 810 is at one sidewall and an air duct 710 associated with the input array 830 is at the opposite sidewall. A top wall 700 of the cooking chamber 102 may also form a surface through which holes or apertures of the input array 830 are formed. Thus, the air duct 710 lies opposite the top wall 700 to form the top and side portions that house the input array 830. The portion of the top wall 700 that is bounded by the air duct 710 may itself also form a heat exchanger surface so that, for example, heat from the cooking chamber 102 heats the portion of the top wall 700 that is bounded by the air duct 710 and therefore also heats air that moves therethrough toward the input array 830.

The preheater 820 may be operably coupled to the air duct 710 via a coupling duct 730. The pressure in the air duct 710 may be expected to be higher than the pressure in the cooking chamber 102, so air flow is driven by the differential pressure. The coupling duct 730 passes through the plenum 320 and particularly through a back wall of the plenum 320 so that the coupling duct 730, and the air duct 710 are all isolated from direct communication with (and therefore are at a lower pressure than) the plenum 320. The coupling duct 730 is operably coupled to an input channel 740 in which the flow regulator may be defined. The input channel 740 may extend rearward from the back wall of the plenum 320 to connect to the preheater 820, which may extend along a back wall of the oven 100. The input channel 740 may therefore extend through a void space in which the motor portion of the fan assembly 300 is disposed.

The catalytic assembly 810 may reside in an output channel that is operably coupled to the plenum 320. Air passed through the catalytic assembly 810 from the plenum 320 may be cleaned by the catalytic assembly 810 and then passed into the output duct 840 of the preheater 820 before being discharged or expelled (e.g., into the void space, or out of the oven 100). Meanwhile, a pressure of the cooking chamber 102 may be less than ambient pressure so that the fresh air 860 is drawn into the preheater 820 to extend into the input channel 740 before entry into the air duct 710 and passage into the cooking chamber 102 via the input array 830.

Thus, hot air from the catalytic assembly 810 (i.e., cleaned air 850) enters into the outlet duct 822 of the preheater 820 and transfers heat to the fresh air 860 in the inlet duct as each air column moves along the common wall 826, which the common wall 826 acting as the heat transfer surface or medium for facilitating the heat transfer. The fresh air 860 heats up to become the input air 870 as the cleaned air 860 cools down to become the expelled air 855.

The input array 830 of this example may include one or more groups of rows of perforations. The perforations may be sized (similar to the inlet perforations 335 and outlet perforations 330) to block any escape of RF energy (at the frequencies employed during operation of the oven 100) from the cooking chamber 102 via the input array 830. The input array 830 and the perforations thereof, may be provided to extend across portions of the top wall 700 of the cooking chamber 102 in a direction substantially perpendicular to the direction of extension of the inlet perforations 335, which also happens to be a direction substantially perpendicular to the direction of extension of the handle of the oven 100. In some cases, the air duct 710 may extend straight forward along one side of the cooking chamber 102 and the input array 830 may define groups of perforations at the beginning and/or end of the air duct 710.

Example embodiments may employ the outlet duct 822 and inlet duct 824 in an arrangement that enables the flows of air therethrough to move in substantially the same direction on either side of a common metallic wall. In some examples, the catalytic element 814 may expel air (i.e., cleaned air 850) at 350° C., while the input duct 824 draws in air at ambient temperatures (e.g., 20° C. to 25° C.). This large difference in temperature across the common wall 826 drives relatively rapid heat exchange to reduce the temperature of expelled air 855 (derived directly from the cleaned air 850) to temperatures closer to ambient, while increasing the temperature of the incoming air (i.e., the fresh air 860) before insertion of the input air 880 into the cooking chamber 102 to avoid serious thermal imbalance. The heat exchanger effect of the preheater 820 therefore acts as an energy recovery system, because the lost heating energy in the output airflow is partially (e.g., around 50%) recovered with the heating provided by the input airflow.

In some cases, the volume of airflow through the catalytic assembly 810 may be about 3% of the total airflow of the first air circulation system. This volume of airflow may reduce effects on airflow uniformity within the cooking chamber 102 due to introduction of the input air 880, but may also be sufficient to provide a full recirculation of the air volume within the cooking chamber 102 two to three times per minute. The volume of airflow through the catalytic assembly 810 may also be low enough to cause relatively low pressure drops. Table 1 below illustrates a table of temperatures for various components of the system in accordance with an example embodiment, and table 2 illustrates a table of airflows through the system.

TABLE 1

| Cooking cavity T (° C.) | Cat. Heater T (° C.) | Cat. Element body T (° C.) | Rear Base T (° C.) | Input Air T (° C.) |
|---|---|---|---|---|
| 120 | 450 | 220 | 40 | 25 |
| 180 | 450 | 270 | 45 | 25 |
| 250 | 450 | 335 | 55 | 25 |

TABLE 2

| Speed | Main airflow ($m^3$/h) | Cat. airflow ($m^3$/h) | Input airflow ($m^3$/h) |
|---|---|---|---|
| min. | 200 | 6 | 6 |
| avg. | 300 | 9 | 9 |
| max. | 400 | 12 | 12 |

In an example embodiment, an oven may be provided. The oven may include a cooking chamber configured to receive a food product, and an air circulation system configured to provide heated air into the cooking chamber. The air circulation system may include an air cleaning system. The air cleaning system may include a catalytic assembly and a preheater. The preheater may be configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the heated input air may be provided into the cooking chamber via an input array comprising a plurality of rows of perforations extending in a direction substantially perpendicular to a direction of extension of a door handle of the oven. In an example embodiment, the catalytic assembly may be configured to clean air extracted from a plenum of the air circulation system. In some cases, the air cleaning system may further include a coupling duct configured to pass the heated input air from the preheater through the plenum while isolating the heated input air from the plenum. Alternatively or additionally, the catalytic assembly may include a catalytic heater and a catalytic element disposed in an insulated compartment that extends rearwardly from the plenum to the outlet duct. In such an example, the outlet duct may communicate expelled air that has been cooled relative to the cleaned air outside the oven. In an example embodiment, the inlet duct and the outlet duct may extend substantially parallel to each other and share a common wall. The common wall may be a heat transfer surface to transfer the heat from the cleaned air to the fresh air between the outlet duct and the inlet duct, respectively. In some cases, the cleaned air and the fresh air may move in substantially a same direction during heat transfer across the common wall through the outlet duct and the inlet duct, respectively. In an example embodiment, the inlet duct and the outlet duct are concentrically arranged. In some cases, the heated input air may be provided into the cooking chamber via an input array. The cooking chamber may include a top wall, and the input array may be formed in the top wall and enclosed by an air duct.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product; and an air circulation system configured to provide heated air into the cooking chamber, wherein the air circulation system comprises an air cleaning system, the air cleaning system comprising:

a catalytic assembly configured to clean air from the cooking chamber; and a preheater configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

2. The oven of claim 1, wherein the heated input air is provided into the cooking chamber via an input array comprising a plurality of rows of perforations extending in a direction substantially perpendicular to a direction of extension of a door handle of the oven.

3. The oven of claim 1, wherein the catalytic assembly cleans air extracted from a plenum of the air circulation system.

4. The oven of claim 3, wherein the air cleaning system further comprises a coupling duct configured to pass the heated input air from the preheater through the plenum while isolating the heated input air from the plenum.

5. The oven of claim 3, wherein the catalytic assembly comprises a catalytic heater and a catalytic element disposed in an insulated compartment that extends rearwardly from the plenum to the outlet duct, wherein the outlet duct communicates expelled air that has been cooled relative to the cleaned air outside the oven.

6. The oven of claim 1, wherein the inlet duct and the outlet duct extend substantially parallel to each other and share a common wall, and wherein the common wall is a heat transfer surface to transfer the heat from the cleaned air to the fresh air between the outlet duct and the inlet duct, respectively.

7. The oven of claim 6, wherein the cleaned air and the fresh air move in substantially a same direction during heat transfer across the common wall through the outlet duct and the inlet duct, respectively.

8. The oven of claim 1, wherein the inlet duct and the outlet duct are concentrically arranged.

9. The oven of claim 1, wherein the heated input air is provided into the cooking chamber via an input array, wherein the cooking chamber comprises a top wall, wherein the input array is formed in the top wall and enclosed by an air duct.

10. The oven of claim 9, wherein the top wall forms a heat exchange surface between air in the air duct and air in the cooking chamber.

11. An air cleaning system for an oven, the air cleaning system comprising:

a catalytic assembly configured to clean air expelled from a cooking chamber of the oven; and a preheater configured to receive hot, cleaned air from the catalytic assembly in an outlet duct to transfer heat to fresh air provided from outside the oven in an inlet duct to preheat the fresh air to heated input air prior to provision of the heated input air into the cooking chamber.

12. The air cleaning system of claim 11, wherein the heated input air is provided into the cooking chamber via an input array comprising a plurality of rows of perforations extending in a direction substantially perpendicular to a direction of extension of a door handle of the oven.

13. The air cleaning system of claim 11, wherein the catalytic assembly cleans air extracted from a plenum of the air circulation system.

14. The air cleaning system of claim 13, wherein the air cleaning system further comprises a coupling duct configured to pass the heated input air from the preheater through the plenum while isolating the heated input air from the plenum.

15. The air cleaning system of claim 13, wherein the catalytic assembly comprises a catalytic heater and a catalytic element disposed in an insulated compartment that extends rearwardly from the plenum to the outlet duct, wherein the outlet duct communicates expelled air that has been cooled relative to the cleaned air outside the oven.

16. The air cleaning system of claim 11, wherein the inlet duct and the outlet duct extend substantially parallel to each other and share a common wall, and wherein the common wall is a heat transfer surface to transfer the heat from the cleaned air to the fresh air between the outlet duct and the inlet duct, respectively.

17. The air cleaning system of claim 16, wherein the cleaned air and the fresh air move in substantially a same direction during heat transfer across the common wall through the outlet duct and the inlet duct, respectively.

18. The air cleaning system of claim 11, wherein the inlet duct and the outlet duct are concentrically arranged.

19. The air cleaning system of claim 11, wherein the heated input air is provided into the cooking chamber via an input array, wherein the cooking chamber comprises a top wall, wherein the input array is formed in the top wall and enclosed by an air duct.

20. The air cleaning system of claim 19, wherein the top wall forms a heat exchange surface between air in the air duct and air in the cooking chamber.

* * * * *